US009814964B2

(12) United States Patent
Shigeta

(10) Patent No.: US 9,814,964 B2
(45) **Date of Patent: *Nov. 14, 2017**

(54) SHUFFLED PLAYING CARDS AND MANUFACTURING METHOD THEREOF

(71) Applicant: Angel Playing Cards Co., Ltd., Osaka (JP)

(72) Inventor: Yasushi Shigeta, Kyoto (JP)

(73) Assignee: ANGEL PLAYING CARDS CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/490,546

(22) Filed: Sep. 18, 2014

(65) Prior Publication Data

US 2015/0081063 A1 Mar. 19, 2015

Related U.S. Application Data

(63) Continuation of application No. 13/764,453, filed on Feb. 11, 2013, now Pat. No. 8,851,479, which is a (Continued)

(30) Foreign Application Priority Data

Nov. 27, 2007 (JP) ..... 2007-306173

(51) Int. Cl.
*A63F 1/02* (2006.01)
*A63F 1/12* (2006.01)

(Continued)

(52) U.S. Cl.
CPC ..... *A63F 1/12* (2013.01); *A63F 1/00* (2013.01); *A63F 1/02* (2013.01); *A63F 1/10* (2013.01);

(Continued)

(58) Field of Classification Search
CPC ..... A63G 1/02

(Continued)

(56) References Cited

U.S. PATENT DOCUMENTS 3,586,334 A * 6/1971 Baumann ..... 273/139
4,513,696 A 4/1985 Fujii et al.

(Continued)

FOREIGN PATENT DOCUMENTS

EP 1316341 6/2003
EP 1566756 8/2005

(Continued)

OTHER PUBLICATIONS

Australian Patent Application No. 2008330607, Office Action dated May 2, 2011.

(Continued)

*Primary Examiner* — Aarti B Berdichevsky
*Assistant Examiner* — Dolores Collins
(74) *Attorney, Agent, or Firm* — Norton Rose Fulbright US LLP

(57) ABSTRACT

The present invention provides shuffled playing cards which eliminate the need for a game host to shuffle cards before games by taking a lot of time as well as eliminate the possibility of cheating. A shuffled playing cards (1) obtained by shuffling a predetermined number of decks of playing cards (12) using a shuffling machine is packaged as an individual pack. The shuffled playing cards (1) is individually packaged and sealed with an adhesive label (13). A bar code (13*a*) which represents a unique shuffled card ID has been printed on the adhesive label (13). The shuffled card ID is registered in a database by being associated with information which allows identification of a shuffling machine used to shuffle the playing card set.

18 Claims, 5 Drawing Sheets

Related U.S. Application Data continuation of application No. 12/832,566, filed on Jul. 8, 2010, now Pat. No. 8,387,983, which is a continuation of application No. 12/744,961, filed as application No. PCT/JP2008/071569 on Nov. 27, 2008, now Pat. No. 8,371,583.

(51) Int. Cl.
*A63F 1/10* (2006.01)
*A63F 11/00* (2006.01)
*A63F 1/00* (2006.01)
*A63F 1/18* (2006.01)

(52) U.S. Cl.
CPC ..... *A63F 11/00* (2013.01); *A63F 1/18* (2013.01); *A63F 2001/022* (2013.01)

(58) Field of Classification Search
USPC ..... 273/293
See application file for complete search history.

(56) References Cited

U.S. PATENT DOCUMENTS 4,513,969 A 4/1985 Samsel, Jr.
4,534,562 A * 8/1985 Cuff et al. ..... 273/149 P
4,586,712 A 5/1986 Lorber et al.
4,619,367 A * 10/1986 Dorman ..... 209/608
4,733,360 A 3/1988 Kobayashi et al.
4,779,401 A * 10/1988 Pedersen ..... 53/520
4,794,239 A 12/1988 Allais
4,995,615 A * 2/1991 Cheng ..... 463/12
5,067,713 A * 11/1991 Soules et al. ..... 273/149 P
5,166,502 A 11/1992 Rendleman et al.
5,169,155 A * 12/1992 Soules et al. ..... 273/293
5,259,907 A 11/1993 Soules et al.
5,331,141 A 7/1994 Kaneko
5,374,061 A 12/1994 Albrecht
5,431,399 A * 7/1995 Kelley ..... 273/149 P
5,522,623 A * 6/1996 Soules et al. ..... 283/91
5,669,816 A 9/1997 Garczynski et al.
5,707,287 A 1/1998 McCrea, Jr.
5,722,893 A 3/1998 Hill et al.
5,779,546 A 7/1998 Meissner
5,810,355 A * 9/1998 Trilli ..... A63F 1/10 273/149 R
5,814,804 A 9/1998 Kostizak
5,911,626 A 6/1999 McCrea, Jr.
5,941,769 A 8/1999 Order
5,989,122 A * 11/1999 Roblejo ..... 463/22
6,039,650 A 3/2000 Hill
6,042,150 A * 3/2000 Daley ..... 283/86
6,066,857 A 5/2000 Fantone et al.
6,093,103 A 7/2000 McCrea, Jr.
6,098,892 A 8/2000 Peoples, Jr.
6,126,166 A 10/2000 Lorson et al.
6,173,267 B1 * 1/2001 Cairns ..... 705/14.12
6,217,447 B1 4/2001 Lofink et al.
6,220,960 B1 * 4/2001 Kryzhanovsky ..... 463/13
6,233,497 B1 * 5/2001 Kachi et al. ..... 700/173
6,267,248 B1 * 7/2001 Johnson ..... A63F 1/12 209/509
6,267,648 B1 7/2001 Katayama et al.
6,270,406 B1 8/2001 Sultan
6,403,908 B2 6/2002 Stardust et al.
6,460,848 B1 10/2002 Soltys et al.
6,527,191 B1 3/2003 Jannersten
6,572,025 B1 6/2003 Nishikado et al.
6,582,301 B2 6/2003 Hill
6,588,751 B1 7/2003 Grauzer et al.
6,629,894 B1 10/2003 Purton
6,637,622 B1 10/2003 Robinson et al.
6,638,161 B2 10/2003 Soltys et al.
6,640,974 B2 * 11/2003 Malone ..... 206/449
6,659,894 B2 12/2003 Kern et al.
6,676,127 B2 * 1/2004 Johnson ..... A63F 1/12 273/149 P
6,726,205 B1 4/2004 Purton
6,886,829 B2 * 5/2005 Hessing et al. ..... 273/149 R
7,029,009 B2 * 4/2006 Grauzer et al. ..... 273/149 P
7,093,130 B1 8/2006 Kobayashi et al.
7,172,507 B2 2/2007 Fujimoto et al.
7,222,852 B2 * 5/2007 Soltys et al. ..... 273/148 R
7,264,241 B2 9/2007 Schubert et al.
7,357,321 B2 * 4/2008 Yoshida et al. ..... 235/454
7,374,170 B2 * 5/2008 Grauzer et al. ..... 273/149 R
7,556,197 B2 * 7/2009 Yoshida ..... G06K 7/10 235/436
7,593,544 B2 9/2009 Downs, III et al.
7,594,613 B2 * 9/2009 Sato et al. ..... 235/494
7,660,676 B2 * 2/2010 Hirata et al. ..... 702/20
7,677,565 B2 3/2010 Grauzer et al.
7,753,373 B2 * 7/2010 Grauzer et al. ..... 273/149 R
7,762,889 B2 * 7/2010 Shigeta ..... 463/29
7,764,836 B2 7/2010 Downs, III et al.
7,766,333 B1 * 8/2010 Stardust ..... A63F 1/12 273/149 R
7,769,232 B2 * 8/2010 Downs, III ..... 382/181
7,933,444 B2 4/2011 Downs, III et al.
7,959,153 B2 6/2011 Franks, Jr.
7,967,672 B2 6/2011 Shigeta
8,012,029 B2 * 9/2011 Johnson ..... A63F 1/12 273/149 R
8,070,160 B2 * 12/2011 Mali ..... 273/149 R
8,150,157 B2 4/2012 Downs, III et al.
8,150,158 B2 4/2012 Downs, III
8,177,628 B2 * 5/2012 Manning et al. ..... 463/21
8,206,223 B2 * 6/2012 Marans et al. ..... 463/43
8,221,244 B2 * 7/2012 French ..... 463/43
8,342,525 B2 * 1/2013 Scheper ..... A63F 1/12 273/149 R
8,371,583 B2 * 2/2013 Shigeta ..... A63F 1/02 273/149 R
8,382,024 B2 2/2013 Fries et al.
8,387,983 B2 * 3/2013 Shigeta ..... A63F 1/10 273/149 R
8,567,786 B2 10/2013 Shigeta
8,801,516 B2 8/2014 Shigeta
8,851,479 B2 * 10/2014 Shigeta ..... A63F 1/10 273/293
8,919,777 B2 12/2014 Shigeta
8,931,779 B2 * 1/2015 Grauzer ..... 273/149 P
8,969,802 B1 3/2015 Blazevic
9,144,732 B2 9/2015 Just
2002/0017481 A1 2/2002 Johnson et al.
2002/0068635 A1 6/2002 Hill
2002/0089434 A1 7/2002 Ghazarian
2002/0155869 A1 10/2002 Soltys et al.
2002/0163125 A1 11/2002 Grauzer et al.
2002/0165029 A1 11/2002 Soltys et al.
2003/0171142 A1 9/2003 Kaji et al.
2003/0176209 A1 9/2003 Soltys et al.
2003/0195025 A1 10/2003 Hill
2004/0026636 A1 2/2004 Shigeta
2004/0100026 A1 5/2004 Haggard
2005/0121852 A1 6/2005 Soltys et al.
2005/0137005 A1 6/2005 Soltys et al.
2005/0255905 A1 * 11/2005 Duke ..... A63F 3/0605 463/17
2006/0247036 A1 11/2006 Shigeta
2007/0024449 A1 2/2007 Bilyeu et al.
2007/0057468 A1 * 3/2007 Bruner, Jr. ..... A63F 1/02 273/292
2007/0102879 A1 * 5/2007 Stasson ..... 273/149 R
2007/0111773 A1 * 5/2007 Gururajan et al. ..... 463/11
2007/0225055 A1 9/2007 Weisman
2008/0105750 A1 5/2008 Shigeta
2008/0182644 A1 * 7/2008 Lutnick et al. ..... 463/20
2009/0093300 A1 * 4/2009 Lutnick et al. ..... 463/26
2010/0103643 A1 * 4/2010 Lin et al. ..... 362/16
2010/0213673 A1 8/2010 Garcia
2010/0224516 A1 * 9/2010 Abell ..... 206/307

(56) References Cited

U.S. PATENT DOCUMENTS

| | | | | |
|---|---|---|---|---|
| 2010/0295243 | A1* | 11/2010 | Stardust | A63F 1/12 273/149 R |
| 2010/0320684 | A1* | 12/2010 | Mali | 273/149 R |
| 2010/0327525 | A1* | 12/2010 | Shigeta | 273/149 R |
| 2011/0079959 | A1* | 4/2011 | Hartley | 273/292 |
| 2011/0130185 | A1 | 6/2011 | Walker | |
| 2011/0210175 | A1 | 9/2011 | Shigeta | |
| 2013/0207344 | A1 | 8/2013 | Shigeta | |

FOREIGN PATENT DOCUMENTS

| | | |
|---|---|---|
| JP | S62251372 | 11/1987 |
| JP | H5-398 | 1/1993 |
| JP | H5-20512 | 1/1993 |
| JP | 9-215812 | 3/1997 |
| JP | 2001222687 | 8/2001 |
| JP | 2002165916 | 6/2002 |
| JP | 2002224443 | 8/2002 |
| JP | 2003052902 | 2/2003 |
| JP | 2003070956 | 3/2003 |
| JP | 2003144742 | 5/2003 |
| JP | 2003250950 | 9/2003 |
| JP | 2004215806 | 8/2004 |
| JP | 2005198668 | 7/2005 |
| JP | 2005267625 | 9/2005 |
| JP | 2005296634 | 10/2005 |
| JP | 2007236995 | 9/2007 |
| JP | 2008188471 | 8/2008 |
| JP | 2009213520 | 9/2009 |
| WO | 9614115 | 5/1996 |
| WO | 9943404 | 9/1999 |
| WO | 0156670 | 8/2001 |
| WO | 02064225 | 8/2002 |
| WO | 03026763 | 4/2003 |
| WO | 03061787 | 7/2003 |
| WO | 2005035084 | 4/2005 |
| WO | 2012053179 | 4/2012 |

OTHER PUBLICATIONS

European Patent Application No. 08853245.2, Supplementary European Search Report dated Jan. 4, 2012.

International Application No. PCT/JP2008/071569, International Search Report and Written Opinion dated Feb. 24, 2009.

U.S. Appl. No. 10/542,073, Final Office Action dated Apr. 14, 2010.

U.S. Appl. No. 11/884,021, Non-Final Office Action dated Dec. 8, 2010.

U.S. Appl. No. 11/929,727, Non-Final Office Action dated Oct. 1, 2010.

U.S. Appl. No. 12/231,657, Final Office Action dated Dec. 8, 2010.

U.S. Appl. No. 12/231,657, Non-Final Office Action dated Mar. 19, 2010.

U.S. Appl. No. 12/825,261, Non-Final Office Action dated Nov. 23, 2010.

* cited by examiner

SHUFFLED PLAYING CARDS AND MANUFACTURING METHOD THEREOF

CROSS-REFERENCE TO RELATED APPLICATIONS

This application is a continuation of U.S. patent application Ser. No. 13/764,453, filed Feb. 11, 2013, now U.S. Pat. No. 8,851,479; which is a continuation of U.S. patent application Ser. No. 12/832,566, filed Jul. 8, 2010, now U.S. Pat. No. 8,387,983; which is a continuation of U.S. patent application Ser. No. 12/744,961, filed May 27, 2010, now U.S. Pat. No. 8,371,583; which is a U.S. national stage entry under 35 U.S.C. §371 of PCT International Application No. PCT/JP2008/071569, filed on Nov. 27, 2008; which claims priority to Japanese Application No. 2007-306173, filed on Nov. 27, 2007; all of which are incorporated herein by reference.

TECHNICAL FIELD

The present invention relates to playing cards used for card games, and more particularly, to shuffled playing cards packaged as an individual pack after being shuffled in a sufficiently random manner and to a manufacturing method thereof.

BACKGROUND

In poker, baccarat, bridge, blackjack, and other card games, a dealer sets one or more decks of playing cards in a card shooter or the like and deals cards to game players by shooting the cards one by one out of the card shooter or the like. In so doing, to ensure fairness of the games, the cards need to be dealt at random. Therefore, a game host has to shuffle the playing cards sufficiently randomly before the playing cards are set in the card shooter.

A conventional card shuffling apparatus used to shuffle cards is disclosed, for example, in Patent Document 1.

Patent Document 1: Japanese Patent Laid-Open No. 2005-198668

However, when the game host shuffles cards before a game, the shuffling can sometimes take a lot of time, hampering efficient operation of the game. Also, when the game host shuffles, there is a problem of possible cheating such as insertion/removal or switching of cards.

The present invention has been made in view of the above problems and has an object to provide shuffled playing cards and manufacturing method thereof which eliminate the need for a game host to shuffle cards before games by taking a lot of time as well as eliminate the possibility of cheating.

SUMMARY

The present invention provides a manufacturing method of shuffled playing cards characterized by comprising: a shuffling step of shuffling a predetermined number of decks of playing cards by a shuffling machine and thereby producing a set of shuffled playing cards; a packaging step of individually packaging each shuffled playing cards subjected to the shuffling step; an ID generating step of creating a different shuffled card ID for each set of shuffled playing cards subjected to the shuffling step using an information processor; an ID affixing step of affixing the shuffled card ID as an ID code to a package of the shuffled playing cards; and an ID registration step of registering the shuffled card ID in a database by associating the shuffled card ID with information which allows identification of the shuffling machine or a shuffling machine group involved in the shuffling step of the shuffled playing cards affixed with the shuffled card ID.

The present invention provides shuffled playing cards which are a predetermined number of decks of playing cards shuffled and individually packaged, characterized in that a shuffled card ID for use to access information in a database is affixed as an ID code to a package of the shuffled playing cards, where the information allows identification of a shuffling machine or a shuffling machine group used to shuffle the shuffled playing cards.

The present invention can provide shuffled playing cards which eliminate the need for a game host to shuffle cards before games by taking a lot of time as well as eliminate the possibility of cheating. Also, since a shuffled card ID associated with information which allows identification of the shuffling machine or shuffling machine group used to shuffle the shuffled playing cards is affixed to the package, if there is any problem with playing cards and it is believed that the cause of the problem lies in a shuffling machine, the manufacturer can easily identify which shuffling machine or shuffling machine group has caused the problem and take quick measures.

BRIEF DESCRIPTION OF THE DRAWINGS

The features and advantages of the present invention will be more fully understood with reference to the following, detailed description of an illustrative embodiment of the present invention when taken in conjunction with the accompanying figures, wherein.

DETAILED DESCRIPTION

Embodiments of shuffled playing cards and manufacturing method thereof according to the present invention will be described below with reference to the drawings.

Figure 1A:
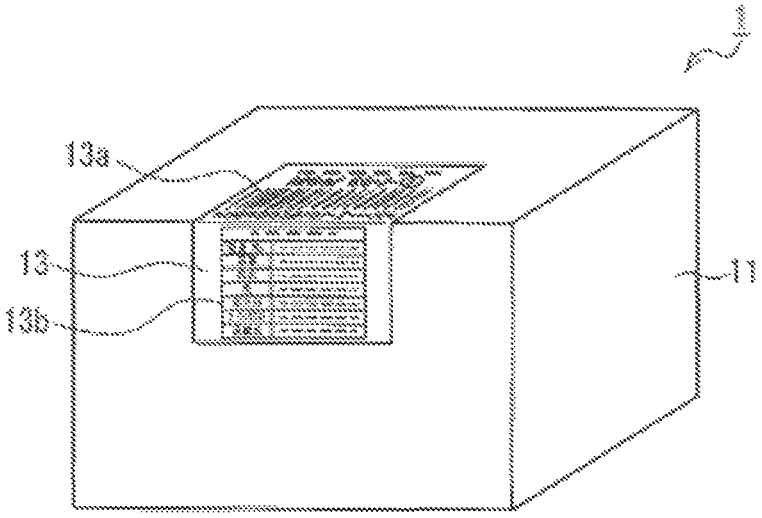
FIGS. 1(*a*) and 1(*b*) are perspective views showing appearance of a shuffled playing card set (packaged individually) according to an embodiment of the present invention.
Figure 1B:
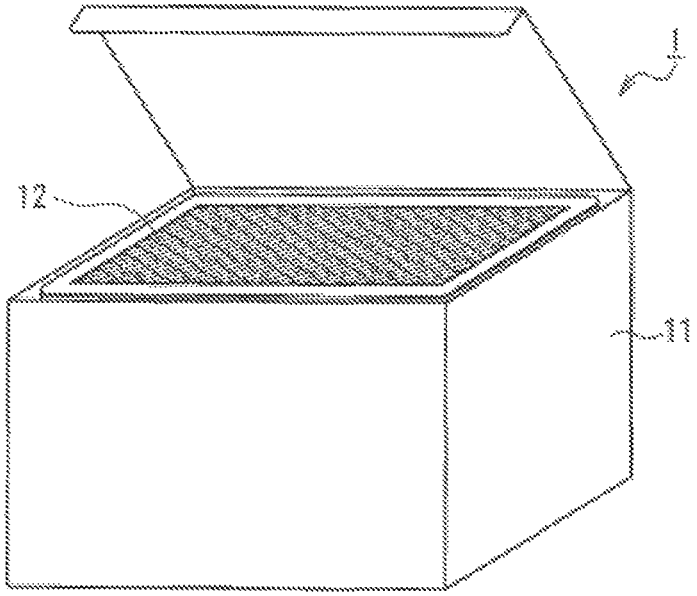

FIGS. 1(*a*) and 1(*b*) are perspective views showing appearance of a shuffled playing card set (packaged individually) according to one embodiment of the present invention. As shown in FIGS. 1(*a*) and 1(*b*), the shuffled playing card set 1 according to the present embodiment is sufficiently shuffled playing cards encased in a paper box 11 whose lid is sealed with an adhesive label 13. A predetermined number of decks (e.g., four decks or eight decks) form a set according to the type of game or the like in which the playing cards 12 are used. Incidentally, although a paper box is used for packaging in this example, the type of packaging is not limited to this. For example, a plastic box may be used alternatively. Instead of a box, the playing cards may be wrapped with a wrapper such as paper or plastic film and sealed with an adhesive label. The point is that the packaging can prevent the seal from being broken open before a game with subsequent cheating such as arranging cards in a different sequence, inserting or removing cards, or marking cards in some way or other.

A bar code 13*a* and specification table 13*b* are printed on the adhesive label 13. As described in detail later, the bar code 13*a* represents an ID (shuffled card ID) which can uniquely identify the shuffled playing card set 1. The specification table 13*b*, which is not absolutely necessary, can contain any information about the playing cards, such as a serial number, a product number, a product name, a color, and a date of manufacture.

As can be seen from FIGS. 1(*a*) and 1(*b*), since the shuffled playing card set 1 has a mouth of the lid of the paper box 11 sealed with the adhesive label 13, in order to use the shuffled playing card set 1, the adhesive label 13 has to be removed or broken. To prevent cheating, preferably the adhesive label 13 is made of a material which, once peeled off, cannot be returned to its original attached state or is configured to be broken at least partially upon application of an external force tending to peel off the adhesive label 13.

As described above, since the shuffled playing card set 1 according to the present embodiment contains shuffled playing cards 12 shuffled in a sufficiently random manner and packaged individually in the paper box 11 sealed with the adhesive label 13, in order to use the shuffled playing card set 1 in a game, it is only necessary to open the paper box 11 and set the playing cards 12 promptly in a shooter. This eliminates the need for a game host to shuffle the playing cards. It also eliminates the possibility of cheating such as insertion/removal or switching of cards during shuffling.

Next, the manufacturing method of the shuffled playing card set 1 according to the present embodiment will be described.

Preferably, a manufacturing process of the shuffled playing card set 1 according to the present embodiment is placed under consistent process control from order receipt to shipment by means of a process control system. A manufacturing process which uses such a process control system will be described in the present embodiment.

First, when an order is received from a customer, a manufacturer of the shuffled playing card set 1 assigns and enters an order receipt number in the process control system. The order receipt number may be assigned and entered using any desired method, and may be assigned automatically by the process control system.

As in the case of conventional playing cards, the shuffled playing card set 1 according to the present embodiment is manufactured using playing cards created through processes in which suit and rank are printed on one side of card base paper, a design is printed on the other side, and the printed card base paper is cut into individual cards on a cutting machine. Then, a predetermined number of decks of the playing cards are grouped together according to the application of the playing cards (depending on what game the playing cards will be used in), shuffled sufficiently randomly, packaged as an individual pack, and sealed to produce the shuffled playing card set 1 described above.

Before printing the card base paper, the manufacturer of the shuffled playing card set 1 enters base paper information (e.g., maker, product name, purchase date, paper lot number, and the like) in the process control system. In a printing process, the manufacturer of the shuffled playing card set 1 enters printing process information (printing machine number, printing date/time, lot number, and the like) in the process control system. Additionally, in a cutting process, the manufacturer of the shuffled playing card set 1 enters cutting process information (cutting machine number, cutting date/time, lot number, and the like) in the process control system. Consequently, predetermined information out of information entered in each process is associated with the shuffled card ID in a database of the process control system as described later.

Next, a shuffling process according to one embodiment of the present invention will be described.

Figure 2:
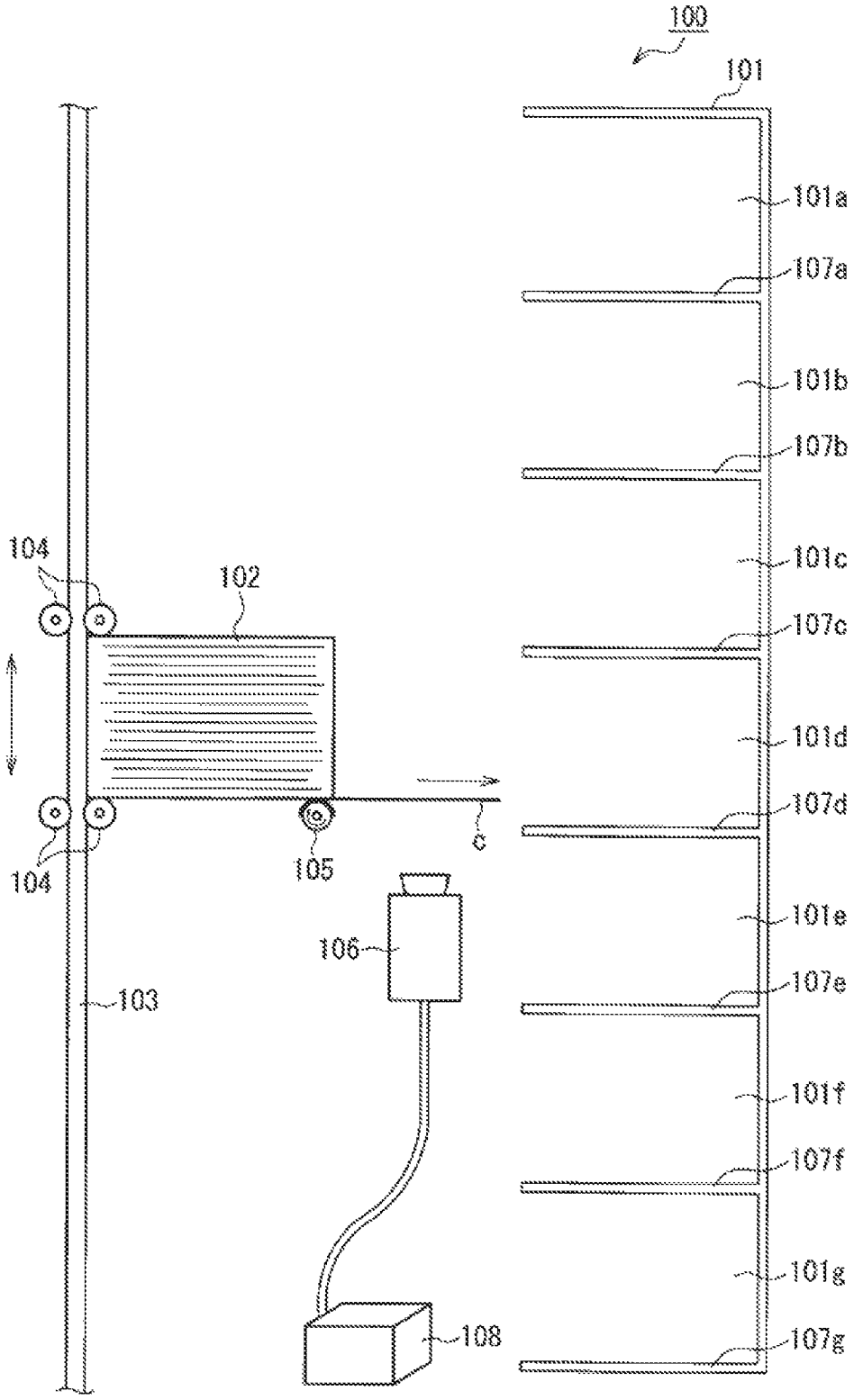
FIG. 2 is a diagram showing a schematic configuration of a shuffling machine used to shuffle playing cards in a manufacturing process of the shuffled playing card set according to the embodiment of the present invention.

FIG. 2 is a diagram showing a schematic configuration of a shuffling machine 100 used to shuffle playing cards in the manufacturing process of the shuffled playing card set 1 according to the present embodiment. As shown in FIG. 2, the shuffling machine 100 includes a card stack holder 101, a card feeder 102, a slide rail 103, feeder travel rollers 104, a card delivery roller 105, a camera 106 (or a card sensor 109 described later), and an image processing unit 108.

The card stack holder 101 has multiple pockets 101*a* to 101*g*. Incidentally, although in the configuration shown as an example in FIG. 2, the card stack holder 101 has seven pockets, the card stack holder 101 may have any number of pockets. Movable partition plates 107*a* to 107*f* are installed between the pockets. The card feeder 102 is designed such that when all the playing cards to be shuffled are placed on the card feeder 102, the card delivery roller 105 on the bottom rotates, sending out a card c from the lowermost part of the card feeder 102 toward the card stack holder 101 through a card delivery port provided in a lower flank of the card feeder 102. Also, the card feeder 102 is configured to be slidable in a vertical (up and down) direction along the slide rail 103 by means of the feeder travel rollers 104 driven by drive means such as a motor (not shown).

With the configuration described above, the shuffling machine 100 alternately slides the card feeder 102 to a position facing any of the pockets 101*a* to 101*g* and sends out the card c from the card feeder 102 to the pocket. Incidentally, the shuffling machine 100 determines the position to move the card feeder 102 to, i.e., the position facing one of the pockets 101*a* to 101*g*, at random using a random number generator program or the like. Consequently, the cards loaded in the card feeder 102 is sent out one by one in a random order to the pockets 101*a* to 101*g* of the card stack holder 101. When all the cards loaded in the card feeder 102 are sent out to the card stack holder 101, the partition plates 107*a* to 107*f* recede from the inside of the card stack holder 101 and consequently cards sorted into the pockets 101*a* to 101*g* of the card stack holder 101 are taken out of the shuffling machine 100 as a single stack. However, the receding of the pockets 101*a* to 101*g* is not absolutely necessary, and any alternative means may be used. For example, the cards may be taken out of the pockets 101*a* to 101*g* using a robot arm or the like. The above is a single shuffling process performed by the shuffling machine 100. After going through the shuffling process, a set of playing cards loaded in the card feeder 102 are shuffled to some extent. If the card feeder 102 is controlled so as to slide in a highly random manner, a set of playing cards loaded in the card feeder 102 can be shuffled sufficiently randomly after the shuffling machine 100 performs the shuffling process only once. However, as described later, if multiple shuffling machines 100 performing such a shuffling process are used to perform the shuffling process in sequence, the shuffled playing cards can be ordered more randomly.

The playing cards are loaded in the card feeder 102 with the face (side on which suit and rank are printed) down (to the side of the camera 106). Each time a card c is sent out from the card feeder 102 to the card stack holder 101, the camera 106 shoots an image of the card c. The resulting image is sent to the image processing unit 108. Functions of the camera 106 and image processing unit 108 vary among the shuffling machines 100 depending on the position of the shuffling machines 100 on a manufacturing line described below.

Figure 3:
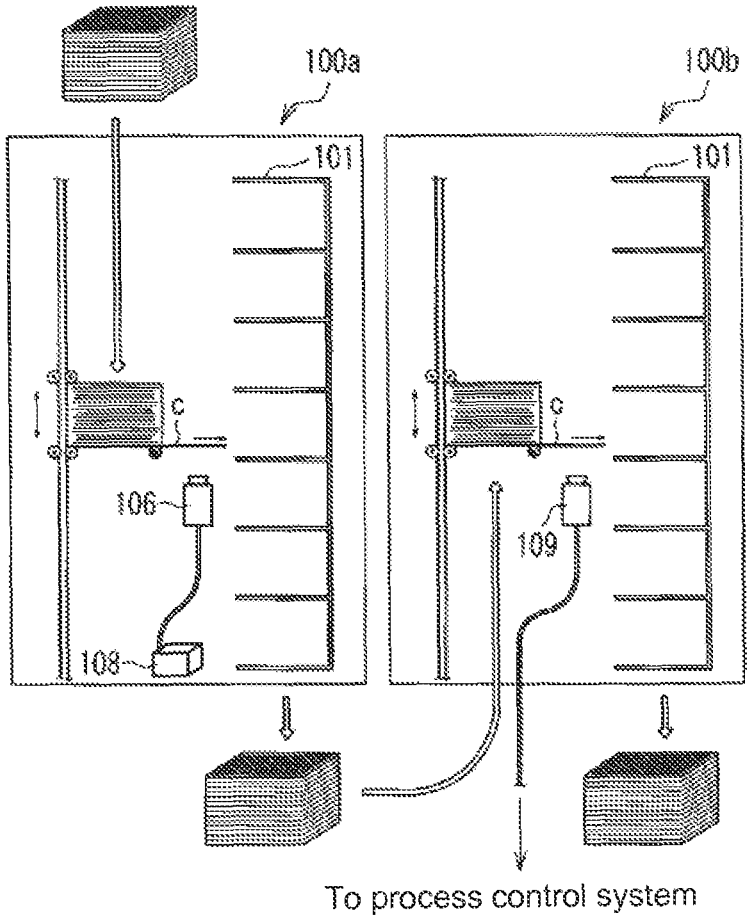
FIG. 3 is a schematic diagram showing part of a manufacturing line for the shuffled playing card set according to the embodiment of the present invention.

FIG. 3 is a schematic diagram showing part of a manufacturing line for the shuffled playing card set 1 according to the present embodiment. The manufacturing line includes multiple shuffling machines 100 configured as described above and arranged in a sequence. Incidentally, although a manufacturing line with two shuffling machines 100 (shuffling machines 100*a* and 100*b*) is shown as an example in FIG. 3, the number of shuffling machines 100 is not limited to this and may be one, or more than two. The shuffling machine 100*a* is configured as shown in FIG. 2, but the shuffling machine 100*b* is equipped with a card sensor 109 instead of the camera 106. The card sensor 109 has the capability to count the number of cards passing above the sensor.

As shown in FIG. 3, first, a set of playing cards made up of a predetermined number of decks is loaded into the card feeder 102 of the shuffling machine 100*a*. The set of playing cards subjected to the shuffling process by the shuffling machine 100*a* is loaded into the card feeder 102 of the shuffling machine 100*b*. The sliding of the card feeders 102 on the shuffling machines 100*a* and 100*b* are controlled independently of each other. After being subjected to the shuffling process twice by the shuffling machines 100*a* and 100*b*, the playing cards are shuffled more randomly.

An image of a card surface shot by the camera 106 on the shuffling machine 100*a* is subjected to an image analysis process by the image processing unit 108 of the process control system which manages the manufacturing line including the shuffling machines 100*a* and 100*b*, and consequently the suit and rank are detected on the card sent out from the card feeder 102 to the card stack holder 101. That is, on the shuffling machine 100*a*, each time a card is sent out from the card feeder 102 to the card stack holder 101, the rank and suit on the card are detected, and when the entire set of cards loaded in the card feeder 102 is sent out to the card stack holder 101, it is checked whether or not there is any excess or deficiency in the rank and suit combinations contained in the set of cards. For example, a set of cards made up of six decks should contain six each of identical cards in terms of the rank and suit combination. If there is any excess or deficiency in the rank and suit combinations, the set of cards is discarded as a defective item. In addition to the rank and suit checking, the image processing unit 108 inspects each card for any smudge and inspects a pattern of a back design and the like as well as inspects whether or not the cards have been cut properly and whether or not each card complies with predetermined standards. Any set of cards containing defects is discarded.

Figure 4:
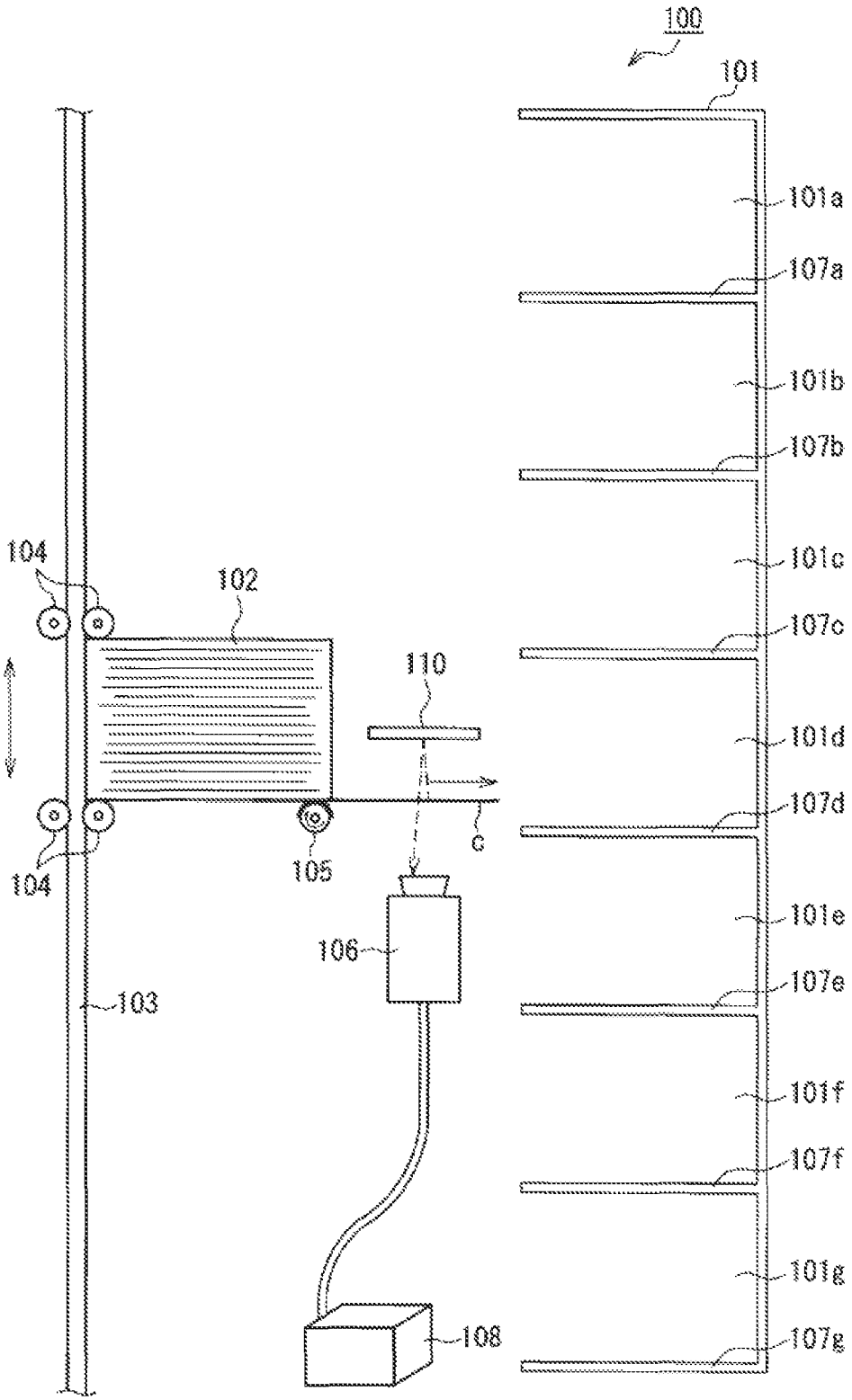
FIG. 4 is a diagram showing a variation of a schematic configuration of the shuffling machine according to the embodiment of the present invention.

Being installed on the shuffling machine 100*b* which performs the shuffling process the second time, the card sensor 109 counts the number of cards passing above the card sensor 109. If three or more shuffling machines are used, preferably the card sensor 109 is installed on the third and subsequent shuffling machines. In this way, the shuffling machine 100*b* checks the number of cards in the set of cards to be shuffled and thereby inspects the final product for excess or deficiency of cards. On the shuffling machine 100*a* which performs the shuffling process the first time, preferably both sides of the card is inspected simultaneously by installing a mirror 110 as shown in FIG. 4 so that the back side (patterned side) of the card will face the camera 106 or by installing another camera (not shown) which will photograph the back side of the card.

When the shuffling machine 100*b* which performs the final shuffling process finishes shuffling, the shuffling machine 100*b* outputs a shuffle-complete signal. Upon detection of the shuffle-complete signal, the process control system generates a shuffled card ID to be assigned to the set of shuffled playing cards completed through the final shuffling process. The shuffled card ID is generated as a unique ID for each shuffled playing card set 1. The process control system associates the generated shuffled card ID with predetermined information out of production information stored in the database of the process control system. Any desired type and volume of such information may be used, but information which identifies the manufacturing line or shuffling machines involved in the shuffling process is particularly important.

Specifically, if there are multiple manufacturing lines, the manufacturer of the shuffled playing card set 1 according to the present embodiment assigns a unique manufacturing line ID to each manufacturing line in advance. Then, upon generation of a shuffled card ID, the process control system registers the generated shuffled card ID in the database by associating the shuffled card ID with the manufacturing line ID of the manufacturing line involved in the manufacture of the shuffled playing cards. However, IDs are not limited to such manufacturing line-related IDs. Alternatively, a shuffling machine ID may be assigned to each shuffling machine in advance and the shuffled card ID may be registered in the database by being associated with all the shuffling machine IDs involved in the shuffling process. Incidentally, the database may be provided either in or outside the process control system.

The generated shuffled card ID is printed on the adhesive label as a bar code by a printing machine. Then, the adhesive label 13 on which the bar code of the shuffled card ID is printed is used to seal the paper box 11 as shown in FIG. 1(*a*).

Figure 5:
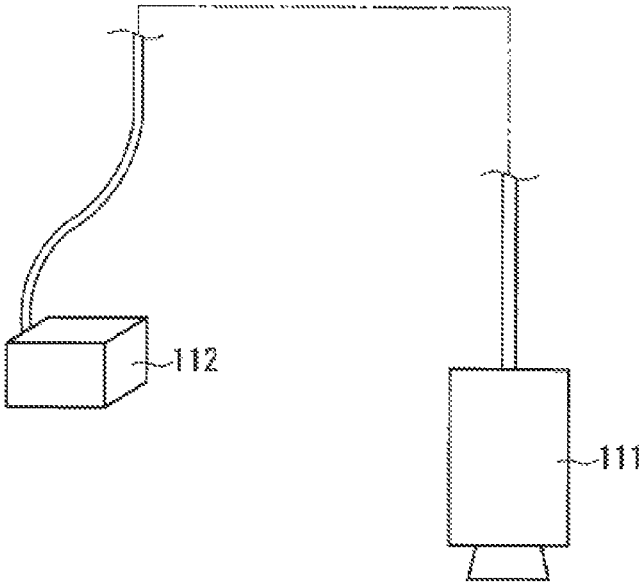
FIG. 5 is a diagram showing how an image used to check the number of playing cards is shot in the manufacturing process of the shuffled playing card set according to the embodiment of the present invention.
Figure 5:
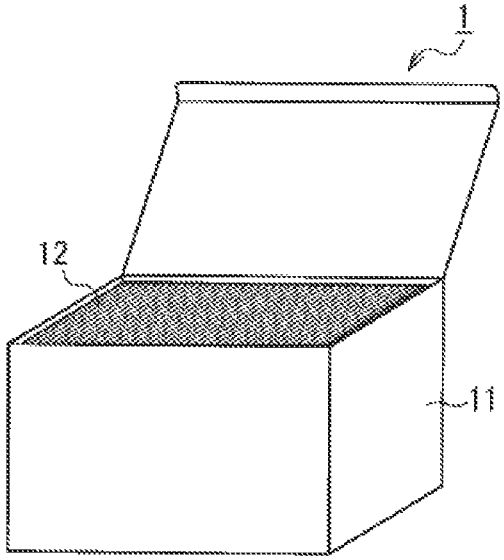

As a variation of the present embodiment, a process for shooting an image of the playing cards 12 encased in the paper box 11 may be added before the paper box 11 is sealed with the adhesive label 13. According to the variation, the set of playing cards 12 completed by going through the final shuffling process is encased in the paper box 11 with a side face up as shown in FIG. 5. Then, with the lid of the paper box 11 open, an image of the playing cards 12 encased in the paper box 11 is shot by a digital camera 111 as shown in FIG. 5. During shooting, preferably the bar code of the shuffled card ID is shot together in the same image. For example, in addition to the adhesive label 13 used to seal the paper box 11, one more adhesive label may be prepared, with the bar code of the same shuffled card ID printed thereon. Then, the additional adhesive label can be pasted on an inner side or the like of the lid of the paper box 11 and shot together with the playing cards 12. Image data resulting from the shooting is saved in a storage device 112 at least temporarily and then registered in the database by being associated with the shuffled card ID. Immediately after shooting, the paper box 11 is sealed with the adhesive label 13. Incidentally, although in the example shown in FIG. 5, an image is shot with the lid of the paper box 11 open, the form of image shooting for the purpose of checking the number of cards is not limited to this. For example, slits or the like may be formed in the lid of the paper box 11 so that the number of cards can be checked even when the lid is closed, and after the lid is closed and sealed, an image may be taken through the slits to check the number of cards. The slits may be sealed after the shooting, for example, using a sealing label other than the adhesive label 13 or using an outer lid.

The image data is used to prove later that a predetermined number of playing cards 12 (e.g., 416 cards in the case of an 8-deck shuffled playing cards) were all present when the paper box 11 was sealed. Otherwise, if the playing cards 12 are found to be excessive or deficient when the cards are used, it is not clear whether someone with malicious intent cheated by removing/slipping in cards or there were manufacturing defects in the first place. By acquiring and saving image data of the playing cards 12 at the time of sealing as with the present variation, it is possible to prove that there was no manufacturing defect. To judge the number of playing cards from the image data, image processing is carried out. That is, in the case of playing cards used, for example, in casinos and the like, to prevent suit and rank from being seen through the back, each card generally has a multilayered structure with black paper and the like being used as an intermediate layer. Consequently, the total number of playing cards 12 can be checked by image processing which detects the black paper or a white portion adjoining the black paper using image data. In the case of cards which do not have an intermediate layer or whose intermediate layer cannot be seen from the side, the total number of playing cards 12 can be checked by performing image processing to detect gaps between stacked playing cards using image data. Therefore, according to the present variation, preferably the image data acquired by shooting has a resolution high enough to enable image processing such as described above.

As described above, by registering the shuffled card ID of the shuffled playing card set 1 in the database by associating the shuffled card ID with the IDs of the manufacturing line or shuffling machine involved in the manufacture of the shuffled playing card set 1 (and with photographic image data such as described above, is necessary), the present embodiment provides the following advantages.

For example, if a customer who has purchased a shuffled playing card set 1 notices any defect in the purchased cards, the customer informs the manufacturer of the shuffled playing card set 1 about the shuffled card ID. In so doing, the customer may send the adhesive label 13 on which the bar code of the shuffled card ID is printed to the manufacturer so that the manufacturer will read the shuffled card ID using a barcode reader. Alternatively, the customer may read the shuffled card ID using a barcode reader or the like and send the obtained data to the manufacturer via communications means such as e-mail. Consequently, by searching the database using the shuffled card ID, the manufacturer can identify a manufacturing line or shuffling machine that may have a problem. In such a case, the manufacturer can alert customers about the shuffled playing card sets 1 manufactured on the same manufacturing line or shuffling machine in the same period and take measures, if necessary, such as requesting the customers to discard the product or recalling the product. Also, by inspecting the identified manufacturing line or shuffling machine, the manufacturer can prevent a recurrence of the defect.

Also, the manufacturer may deliver the shuffled playing card set 1 to the customer together with a portable storage medium containing data (shuffled card ID and related information) on the shuffled playing card set 1 to be delivered by downloading the data from the database at the time of delivery. Any data structure (format) may be used for the data downloaded from the database to the storage medium as long as the data is readable on the customer's computer. Then, if the customer finds a defect such as a bent card, the customer can read the shuffled card ID of the defective shuffled playing card set 1 using a barcode reader or the like and search data on the storage medium based on the shuffled card ID thus acquired. Also, based on search results, the customer can take measures such as discarding shuffled playing card sets 1 related to the same manufacturing line or shuffling machine. Besides, even if fraudulent shuffled playing card sets 1 are mixed in items delivered to the customer, the customer can check the shuffled card IDs of the delivered items with the shuffled card IDs stored in the storage medium. Then, any shuffled playing card set 1 whose shuffled card ID is not contained in the storage medium provided at the time of delivery can be determined to have been mixed for fraudulent purposes. This prevents mixing of fraudulent items by a third party.

Although in the embodiment described above, the manufacturing line ID or the shuffling machine ID of the shuffling machine that performed the shuffling process is stored in the database by being associated with the shuffled card ID, information to be associated with the shuffled card ID is not limited to this. For example, in the above embodiment, the camera 106 is incorporated in the shuffling machine 100 and the image analysis process is performed by the image processing unit 108 simultaneously with shuffling to inspect whether or not all the cards are present. However, as a variation, inspection machines including the camera 106 and image processing unit 108 may be installed downstream of each shuffling process, so that the cards having completed shuffling by the shuffling machines 100*a* and 100*b* can be inputted in the inspection machines to inspect whether or not all the cards are present. In that case, an inspection machine ID may be assigned to each inspection machine in advance and associated with the shuffled card ID assigned to each shuffled playing card set 1.

Besides, various information can be associated with the shuffled card ID, including an ID of the printing machine involved in the printing process, an ID of the cutting machine involved in the cutting process, an ID of the packaging machine involved in a packaging process, a lot number of the base paper, a manufacturing date, a manufacturing date/time, a card type ID, and a customer ID. In that case, the information can be registered in the database by being associated with the shuffled card ID containing the information.

In the above embodiment, the paper box 11 is sealed with the adhesive label 13 on which the shuffled card ID is printed as a bar code. However, forms of the present invention are not limited to this. The shuffled card ID may be affixed to the package as a two-dimensional matrix code such as a so-called QR code. Also, the shuffled card ID may be recorded somewhere other than the sealing label. That is, a method which records the shuffled card ID directly on the package may also be adopted. For example, the shuffled card ID can be affixed to the package by laser irradiation or the like. It is also preferable to attach the shuffled card ID to the package as a PFID or RFID (so-called IC tag).

Furthermore, although in the present embodiment, one shuffled card ID is assigned to one shuffled card set 1, a unique ID may be assigned, for example, to each carton packed with multiple shuffled card sets 1. Alternatively, a unique ID may be assigned to each container used to transport multiple cartons. Even in these cases, if the ID is registered in the database, when any defect is found later, by searching the database based on the ID, it is possible to trace manufacturing and distribution history of the defective product.

For example, in a cartoning process, a predetermined number of shuffled card sets 1 (boxes) are packed in a carton. In so doing, by reading the bar codes 13*a* of the shuffled card sets 1 packed in the carton using a barcode reader, the shuffled card IDs of the shuffled card sets 1 in the carton can be registered easily in the database of the process control system. After the bar codes 13*a* are read from all the shuffled card sets 1 in the carton, the process control system may generate an ID (carton ID) for use to identify the carton and print a bar code which represents the carton ID on an adhesive label. The adhesive label, when pasted to the carton, will enable carton-based management. The generated carton ID is registered in the database by being associated with the shuffled card IDs of the shuffled card sets 1 packed in the carton.

Similarly, when a predetermined number of cartons are loaded on a pallet and multiple pallets are put in a container, the carton IDs may be read from all the cartons loaded on one pallet using a barcode reader and the acquired carton IDs may be registered in the database of the process control system by being associated with an ID (pallet ID) for use to identify the pallet. In that case, after the bar codes are read from all the cartons on one pallet, the process control system generates an ID (pallet ID) for use to identify the pallet and prints the bar code which represents the pallet ID on an adhesive label. The adhesive label, when pasted to the pallet, will enable pallet-based management. When the pallet is loaded in the container, the use of the pallet's bar code makes it possible to record which container the pallet is loaded in.

When the loading into the container is completed, shipment information (customer name, shipment date, destination, transport company, type of delivery service, and the like) by the pallet or container is inputted in the process control system.

Thus, in addition to attaching the shuffled card ID to packages, if a carton ID or pallet ID are attached to cartons or pallets, the shuffled playing cards can be managed on a carton-by-carton basis or pallet-by-pallet basis. Specifically, for example, if any defect is found in a shuffled card set 1, the database can be searched for the IDs of the carton, pallet, and container in which the shuffled card set 1 was contained, based on the shuffled card ID of the shuffled card set 1. This also makes it possible to discard all the shuffled card sets 1 in the carton, pallet, or container in which the defective shuffled card set 1 was contained.

The shuffling machine 100 illustrated in the above embodiment 1s strictly exemplary, and concrete configuration of the shuffling machine is not limited to the above example. For example, in the above, although the card feeder 102 is configured to move by sliding, the card feeder 102 may be fixed, being configured such that the card stack holder 101 will slide relative to the card feeder 102. Also, the configuration for sending out the card from the card feeder 102 is not limited to delivery rollers such as described above, and a mechanism such as a robot arm may be used to take out the card.

Also, although in the above embodiment, the shuffling machine 100*b* issues a shuffled card ID in response to a shuffle-complete signal, the timing to issue the shuffled card ID is not limited to this. For example, the shuffled card ID may be issued at any time such as at the end of an inspection process.

An embodiment of the present invention has been described above, and the scope of the present invention also covers the following annexes.

Annex 1

A playing card manufacturing method comprising a manufacturing process including:

a face printing step of printing rank and suit of playing cards on one side of base paper;

a back side printing step of printing a back design on another side of the base paper;

a step of cutting a card base paper printed in both the face printing step and the back side printing step into individual playing cards on a cutting machine;

a shuffling step of gathering the individual playing cards cut in the cutting step into a predetermined number of decks and shuffling the playing cards to produce a set of shuffled playing cards; and a packaging step of packaging the individual shuffled playing cards produced in the shuffling step, characterized in that a different shuffled card ID is created for each of the individual shuffled playing cards using an information processor in response to a shuffle completion signal from a shuffling machine which carries out the shuffling step, the playing card manufacturing method further comprises an ID affixing step of affixing the shuffled card ID as an ID code to a package of the individual shuffled playing cards, and the shuffled card ID represented by the ID code is configured in a database by being associated with information about the shuffling machine involved in the shuffling step of the corresponding individual shuffled playing cards or information about a production line including the shuffling machine and involved in the manufacturing process, and the database is configured so as to allow identification of the shuffling machine or the production line including the shuffling machine based on the shuffled card ID, the shuffling machine having been involved in the shuffling step in the manufacturing process of the individual playing cards which make up the individual shuffled playing cards.

Annex 2

A playing card manufacturing method comprising a manufacturing process including:

a face printing step of printing rank and suit of playing cards on one side of base paper;

a back side printing step of printing a back design on another side of the base paper;

a step of cutting a card base paper printed in both the face printing step and the back side printing step into individual playing cards on a cutting machine;

a shuffling step of gathering the individual playing cards cut in the cutting step into a predetermined number of decks and shuffling the playing cards to produce a set of shuffled playing cards; and an inspection step of performing an inspection using an inspection machine during or after the shuffling step to ensure that the individual playing cards in the predetermined number of decks which make up the shuffled playing cards are all present;

a packaging step of packaging the individual shuffled playing cards produced in the shuffling step, characterized in that a different shuffled card ID is created for each of the individual shuffled playing cards using an information processor in response to an acceptance signal given by the inspection machine in the inspection step, the playing card manufacturing method further comprises an ID affixing step of affixing the shuffled card ID as an ID code to a package of the individual shuffled playing cards, and the shuffled card ID is configured in a database by being associated with information about the inspection machine involved in the inspection step of the corresponding individual shuffled playing cards or information about a production line including the inspection machine and involved in the manufacturing process, and the database is configured so as to allow identification of the inspection machine or the production line including the inspection machine based on the shuffled card ID, the inspection machine having been involved in the inspection step in the manufacturing process of the individual playing cards which make up the individual shuffled playing cards.

Annex 3

The playing card manufacturing method according to annex 1 or 2, further comprising a step of inputting data which identifies a printing machine used in at least one of the face printing step and the back side printing step, in the information processor, characterized in that the information about the production line which performs the manufacturing process for the individual shuffled playing cards includes the data which identifies the printing machine, and the database is configured so as to allow identification of the printing machine used in the production line for the individual playing cards which make up the individual shuffled playing cards, based on the shuffled card ID.

Annex 4

The playing card manufacturing method according to annex 1 or 2, characterized in that the information about the production line which performs the manufacturing process for the individual shuffled playing cards includes a lot number of the base paper used in the face printing step or the back side printing step, and the database is configured so as to allow identification of the lot number corresponding to the individual playing cards which make up the individual shuffled playing cards, based on the shuffled card ID which identifies the individual shuffled playing cards.

Annex 5

The playing card manufacturing method according to any one of annexes 1 to 4, characterized in that the predetermined number of decks which make up the individual shuffled playing cards is any of 1 to 10.

Annex 6

The playing card manufacturing method according to any one of annexes 1 to 5, further comprising a step of packing a plurality of the packaged individual shuffled playing cards into a transport box, wherein different transport box data is created for each of the transport boxes; the playing card manufacturing method further comprises a step of affixing the corresponding transport box data as an ID code on a surface of the transport box; and the transport box data is included in the database by being associated with the shuffled card IDs which identify the shuffled playing cards in the transport box.

Annex 7

The playing card manufacturing method according to any one of annexes 1 to 6, characterized in that the ID code further contains any of manufacturing date, manufacturing date/time, product type, and customer information concerning the shuffled playing cards identified by the shuffled card ID.

Annex 8

The playing card manufacturing method according to any one of annexes 1 to 7, wherein the ID code which represents the shuffled card ID is attached in barcode format to the corresponding package of the shuffled playing cards.

Annex 9

The playing card manufacturing method according to any one of annexes 1 to 7, wherein the ID code which represents the shuffled card ID is attached in QR code (two-dimensional matrix code) format to the corresponding package of the shuffled playing cards.

Annex 10

The playing card manufacturing method according to any one of annexes 1 to 7, wherein the ID code which represents the shuffled card ID is attached in PFID format to the corresponding package of the shuffled playing cards.

Annex 11

The playing card manufacturing method according to any one of annexes 1 to 7, wherein the ID code which represents the shuffled card ID is attached in IC tag format to the corresponding package of the shuffled playing cards.

Annex 12

Shuffled playing cards manufactured in a manufacturing process which includes:

a face printing step of printing rank and suit of playing cards on one side of base paper;

a back side printing step of printing a back design on another side of the base paper;

a step of cutting a card base paper printed in both the face printing step and the back side printing step into individual playing cards on a cutting machine;

a shuffling step of gathering the individual playing cards cut in the cutting step into a predetermined number of decks and shuffling the playing cards to produce a set of shuffled playing cards; and a packaging step of packaging the individual shuffled playing cards produced in the shuffling step, characterized in that a shuffled card ID created for each individual shuffled playing cards in response to a shuffling step completion signal from the shuffling step is attached to the corresponding package of the individual shuffled playing cards, where the shuffled card ID differs among individual shuffled playing cards, the shuffled card ID is configured in a database by being associated with information about the shuffling machine involved in the shuffling step of the corresponding individual shuffled playing cards or information about a production line including the shuffling machine and involved in the manufacturing process, allowing identification of the shuffling machine or the production line including the shuffling machine, the shuffling machine having been involved in the shuffling step in the manufacturing process of the individual playing cards which make up the individual shuffled playing cards.

Annex 13

Shuffled playing cards manufactured in a manufacturing process which includes:

a face printing step of printing rank and suit of playing cards on one side of base paper;

a back side printing step of printing a back design on another side of the base paper;

a step of cutting the card base paper printed in both the face printing step and the back side printing step into individual playing cards on a cutting machine;

a shuffling step of gathering the individual playing cards cut in the cutting step into a predetermined number of decks and shuffling the playing cards to produce a set of shuffled playing cards; and an inspection step of performing an inspection using an inspection machine during or after the shuffling step to ensure that the individual playing cards in the predetermined number of decks which make up the shuffled playing cards are all present; and a packaging step of packaging the individual shuffled playing cards produced in the shuffling step, characterized in that a shuffled card ID created for each individual shuffled playing cards in response to an acceptance signal given by the inspection machine in the inspection step is attached to the corresponding package of the individual shuffled playing cards, where the shuffled card ID differs among individual shuffled playing cards, the shuffled card ID is configured in a database by being associated with information about the inspection machine involved in the inspection step of the corresponding individual shuffled playing cards or information about a production line including the inspection machine and involved in the manufacturing process, allowing identification of the inspection machine or the production line including the inspection machine, the inspection machine having been involved in the inspection step in the manufacturing process of the individual playing cards which make up the individual shuffled playing cards Annex 14

The shuffled playing cards according to annex 12 or 13, characterized in that the ID code further contains any of manufacturing date, manufacturing date/time, product type, and customer information concerning the shuffled playing cards identified by the shuffled card ID.

Annex 15

The shuffled playing cards according to according to any one of annexes 12 to 14, characterized in that the predetermined number of decks is any of 1 to 10.

Annex 16

The playing card manufacturing method according to any one of annexes 12 to 15, characterized in that the ID code which represents the shuffled card ID is attached in barcode format or two-dimensional matrix code format (such as QR code format) to the corresponding package of the shuffled playing cards.

Annex 17

The shuffled playing cards according to annex 16, characterized in that the ID code is printed on a label, which is attached to the package of the shuffled playing cards.

Annex 18

The shuffled playing cards according to annex 16, characterized in that the ID code is attached to the package of the individual shuffled playing cards using a laser beam.

Annex 19

The playing card manufacturing method according to any one of annexes 12 to 15, wherein the ID code which represents the shuffled card ID is attached in PFID format to the corresponding package of the shuffled playing cards.

Annex 20

The playing card manufacturing method according to any one of annexes 12 to 15, wherein the ID code which represents the shuffled card ID is attached in IC tag format to the corresponding package of the shuffled playing cards.

Annex 21

The shuffled playing cards according to any one of annexes 12 to 20, wherein a tamper-evident adhesive label is attached to the package of the individual shuffled playing cards.

INDUSTRIAL APPLICABILITY

The present invention has industrial applicability in the field of shuffled playing cards and a manufacturing method thereof.

I claim:

1. A card inspection device configured to:

automatically detect, using one or more processors, at least a rank and a suit of each card of one or more shuffled decks of playing cards;

inspect, using the one or more processors, the one or more shuffled decks of playing cards one by one sequentially after shuffling;

determine whether the one or more shuffled decks of playing cards is defective based on a group of information comprising the rank and the suit of the playing cards detected, and upon a condition that the decks of playing cards is determined to be defective, treating or handling a set of playing cards which is determined to be defective as a defective item;

generate a signal indicating the result of the inspection wherein the condition that the decks of playing cards is defective comprises at least one of:

1) an excess or deficiency in the predetermined number of the playing cards, and 2) a defect in the arrangement of the playing cards.

2. The card inspection device according to claim 1, wherein a shuffled card ID is associated with the one or more shuffled decks of playing cards.

3. The card inspection device according to claim 2, wherein a different shuffled card ID is associated with each of the one or more shuffled decks of playing cards.

4. The card inspection device according to claim 2, wherein the shuffled card ID identifies a shuffling machine or a group of shuffling machines used to shuffle the one or more shuffled decks of playing cards.

5. The card inspection device according to claim 2, wherein the shuffled card ID comprises information about the one or more shuffled decks of playing cards comprising a serial number, a product number, a product name, a color, a date of manufacture, a time of manufacture, a lot number of a base paper, a card type ID, or a customer ID.

6. The card inspection device according to claim 2, wherein the shuffled card ID comprises an ID of a printing machine involved in printing the one or more shuffled decks of playing cards, an ID of a cutting machine involved in the cutting of the one or more shuffled decks of playing cards, or an ID of a packing machine involved in the packaging of the one or more shuffled decks of playing cards.

7. The card inspection device according to claim 2, wherein the shuffled card ID comprises a bar code.

8. The card inspection device according to claim 2, wherein the shuffled card ID comprises a PFID or a RFID.

9. The card inspection device according to claim 2, wherein the shuffled card ID is printed on an adhesive label.

10. The card inspection device according to claim 2, wherein the shuffled card ID is printed by laser irradiation.

11. The card inspection device according to claim 9, wherein the adhesive label is placed on a package containing the one or more shuffled decks of playing cards.

12. The card inspection device according to claim 7, wherein the bar code is a two-dimensional matrix code.

13. The card inspection device according to claim 1, wherein the defect in the arrangement of the playing cards comprises a defect in the rank and suit combinations.

14. The card inspection device according to claim 1, wherein the condition that the decks of playing cards is defective further comprises noncompliance with predetermined standards.

15. The card inspection device according to claim 1, wherein the treating or handling a set of playing cards which is determined to be defective as a defective item comprises discarding the defective item.

16. The card inspection device according to claim 1, wherein the condition that the decks of playing cards is defective further comprises a smudge, improper back design pattern, or improper cut.

17. The card inspection device according to claim 1, wherein a manufacturing line ID is associated with the one or more shuffled deck of playing cards.

18. The card inspection device according to claim 1, wherein a carton ID is associated with one or more cartons containing the one or more shuffled deck of playing cards.

* * * * *